US005884966A

United States Patent [19]

Hill et al.

[11] Patent Number: 5,884,966

[45] Date of Patent: Mar. 23, 1999

[54] PORTABLE SHOOTER'S SEAT HAVING A DETACHABLE BENCH AND FIREARM SUPPORT

[76] Inventors: Marshall T. Hill, HC81 Box 108, Needmore, Pa. 17238; Timothy G. Peacemaker, HC 71 Box 96, Capon Bridge, W. Va. 26711

[21] Appl. No.: 13,973

[22] Filed: Jan. 27, 1998

[51] Int. Cl.[6] ..... A47B 83/02

[52] U.S. Cl. ..... 297/170; 297/174; 42/94

[58] Field of Search ..... 297/170, 171, 297/172, 174; 42/94; 89/37.01, 37.04

[56] References Cited

U.S. PATENT DOCUMENTS

| | | | |
|---|---|---|---|
| 1,209,388 | 12/1916 | Brown | 248/167 |
| 1,823,616 | 9/1931 | Leslie | 248/167 |
| 1,931,584 | 10/1933 | Luff | 248/167 |
| 2,071,332 | 2/1937 | Chapman | 248/122.1 |
| 2,673,595 | 3/1954 | Kump, Jr. | 297/172 |
| 4,067,606 | 1/1978 | Desmoulins | 297/170 X |
| 4,798,411 | 1/1989 | Lin | 297/170 |
| 5,149,900 | 9/1992 | Buck | 42/94 |
| 5,271,175 | 12/1993 | West, III | 297/170 X |
| 5,711,572 | 1/1998 | Khan | 297/174 X |

FOREIGN PATENT DOCUMENTS

| | | | |
|---|---|---|---|
| 1135080 | 4/1957 | France | 297/174 |
| 371636 | 3/1939 | Italy | 297/170 |

*Primary Examiner*—Peter R. Brown
*Attorney, Agent, or Firm*—Brady, O'Boyle & Gates

[57] ABSTRACT

A portable shooter's seat having a detachable bench and firearm support. The seat and bench have a plurality of legs, some of which are pivotally connected to the seat and bench, respectively. The seat and bench each have one leg fixedly connected thereto and attachable to each other for connecting the seat to the bench. For supporting the seat on the ground independently from the bench, the seat and bench legs are disconnected, and the set leg is reoriented to the ground supporting position. Some of the seat and bench legs are foldable to a stored position, and a shoulder strap is connected between the bench and the seat to facilitate carrying the bench and seat in the stored position. A firearm support is connectable to the seat when the seat is detached from the bench.

10 Claims, 6 Drawing Sheets

PORTABLE SHOOTER'S SEAT HAVING A DETACHABLE BENCH AND FIREARM SUPPORT

BACKGROUND OF THE INVENTION

Various portable shooter's seats have been proposed for connection to benches and to firearm supports. While these portable shooter's seats have been satisfactory for their intended purpose, their versatility has been somewhat limited, in that a seat designed for a bench could not also be used with a firearm support, and, conversely, the same seat designed for use with a firearm support could not be used with a bench Such arrangements are disclosed in U.S. Pat. No. 5,149,900 dated Sep. 22, 1992 and No. 5,271,175 dated Dec. 21, 1993.

SUMMARY OF THE INVENTION

The portable shooter's seat of the present invention is an improvement over the prior art shooter's seats in that it is readily detachable from a bench for use with a firearm support, and the firearm support can be readily detached from the seat which can be, once again, connected to the bench.

The portable shooter's seat of the present invention comprises, essentially, a seat portion having a back rest portion pivotally connected thereto. The seat is supported by a plurality of inclined legs, some of which are pivotally connected about vertical axes to the bottom surface of the seat. At least one of the inclined seat legs is fixedly connected to the bottom surface of the seat, but detachable therefrom, for selectively attaching the seat to a leg of a bench or for supporting the seat on the ground independently from the bench.

The bench is also provided with a plurality of inclined legs, some of which are pivotally connected about vertical axes to the bottom surface of the bench, in the same manner as the seat legs are pivotally connected to the seat. By this construction and arrangement, the back rest portion of the seat can be folded downwardly against the seat portion and the legs of the bench and seat can be pivoted to a stored position, whereby the bench and associated seat can be carried. A shoulder strap is detachably connected between the bench and seat to facilitate the carrying of the portable shooter's seat and bench by a shooter.

For supporting the seat on the ground independently from the bench, the fixed leg on the seat is detached from a similar fixed leg on the bench and reoriented to the ground supporting position for reconnection to the seat.

DESCRIPTION OF THE PREFERRED EMBODIMENTS

Figure 1:
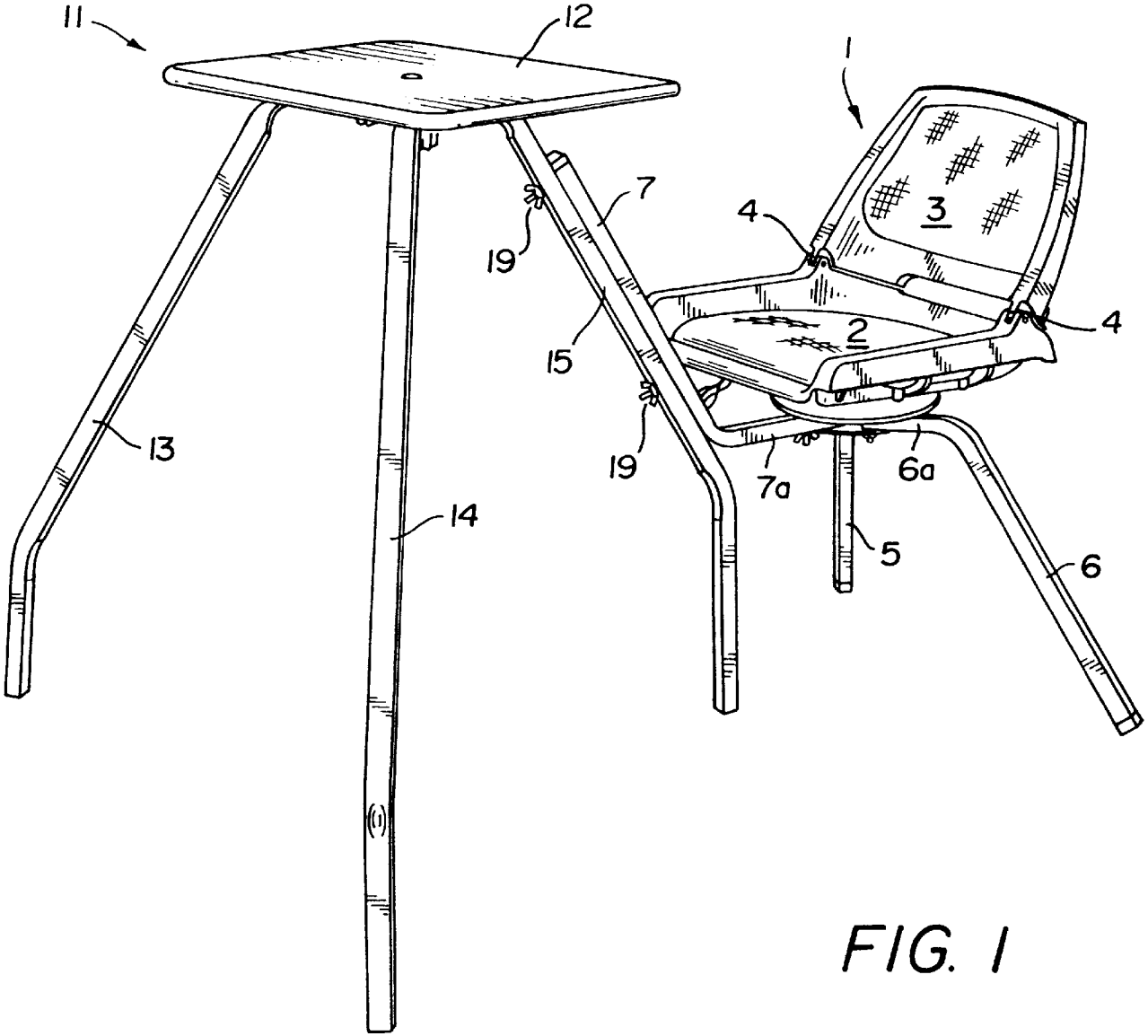
FIG. 1 is a perspective view of the shooter's seat of the present invention connected in the operative position to a bench.

Referring to the drawings and, more particularly, to FIGS. 1, 5, 6, and 7, the shooter's seat 1 of the present invention comprises a chair having a seat portion 2 and a back rest portion 3 pivotally connected to the seat portion 2 as at 4. The seat portion 2 is supported by a plurality of inclined legs 5, 6, and 7, terminating at their upper ends with horizontally extending portions 5*a*, 6*a*, and 7*a*.

The legs 5, 6, and 7 are connected to a circular plate 8 having a plurality of depending bolts 5*b*, 6*b*, 7*b*, and 7*c* depending from the plate 8 and extending through the respective horizontal portions 5*a*, 6*a*, and 7*a* of the legs 5, 6, and 7. An oval plate 9 is positioned beneath circular plate 8 and spaced therefrom. The bolts 5*b*, 6*b*, 7*b*, and 7*c* extend through the plate 9 and are held thereon by suitable nuts 5*c*, 6*c*, and 7*d*. The plates 8 and 9 and associated legs 5, 6, and 7 are connected as a subassembly to the bottom of the seat 2 by a central bolt 10, integral with the bottom of the seat 2 and depending therefrom and extending through a central aperture 8*a* in plate 8, a threaded knob 10*a* being connected to the bolt 10 for holding the subassembly in place. The bolt 10 also provides a shaft for rotation of the seat 1 about a vertical axis.

Figure 7:
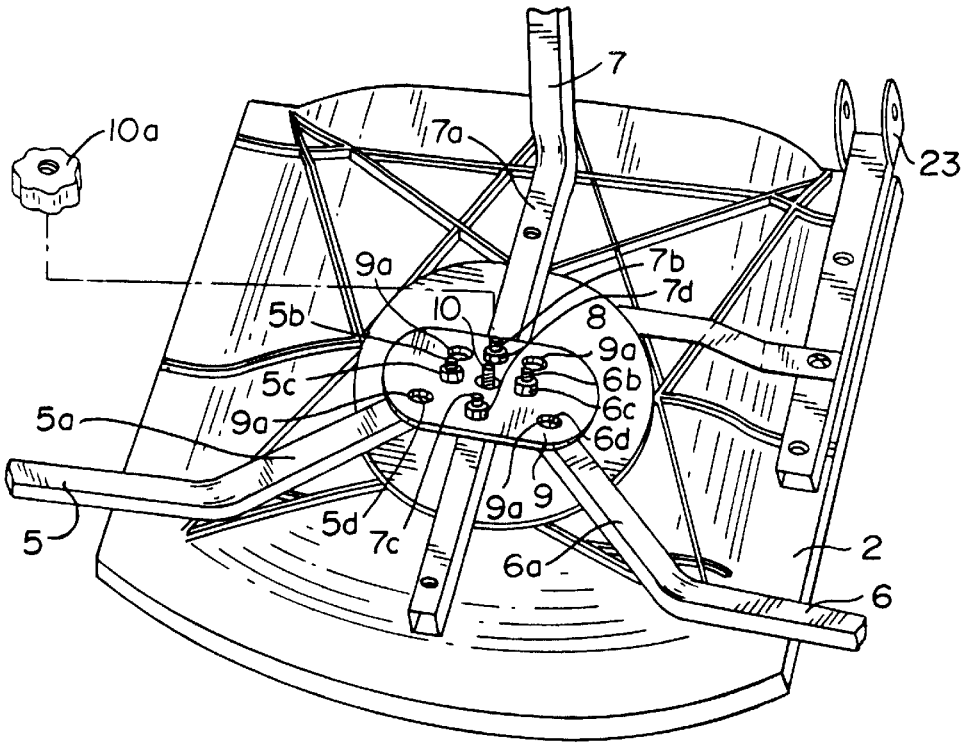
FIG. 7 is a perspective view of the bottom of the seat, illustrating the pivotal connections of the legs thereto.

While the nut and bolt assemblies 7*b*, 7*c*, and 7*d* hold leg 7 in a fixed position relative to the seat 2, the nut and bolt assemblies 5*b*, 5*c*, 6*b*, and 6*c* provide pivotal connections, whereby the legs 5 and 6 can be pivoted about vertical axes provided by the bolts 5*b* from an operative position as shown in FIG. 7 to a stored position similar to that shown in FIG. 8, to be described more fully hereinafter.

In order to hold the legs 5 and 6 in the desired position, a detent assembly is provided buttons 5*d* and 6*d* releasably received in apertures 9*a* provided in the plate 9.

While the inclined legs 5 and 6 of the chair depend downwardly for engagement with the ground, the inclined leg 7 extends upwardly for connection to a bench 11 having a platform 12 supported by a plurality of inclined legs 13, 14, and 15 having horizontal portions 13*a*, 14*a*, and 15*a* connected as a subassembly to the bottom of the platform 12 in a manner similar to the chair leg subassembly described hereinabove. To that end, a circular plate 16 has a plurality of depending bolts 13*a*, 14*a*, 15*a*, and 15*b*, affixed thereto, depending downwardly therefrom and extending through the respective horizontal portions 13*a*, 14*a*, and 15*a* of legs 13, 14, and 15. An oval plate 17 is positioned below the circular plate 16 with the horizontal portions 13*a*, 14*a*, and 15*a* of the legs 13, 14, and 15 positioned in the space between the plates 16 and 17 and held therein by the bolts 13*b*, 14*b*, 15*b*, and 15*c* extending through the plate 17 and held therein by suitable nuts 13*c*, 14*c*, and 15*d*. While the bolts 15*b* and 15*c* hold leg 15 in the fixed position relative to plates 16 and 17, bolts 13*b* and 14*b* provide vertical pivotal axes so that the legs 13 and 14 can be pivoted from the operative position as shown in phantom in FIG. 8 to the folded or stored position as shown in solid lines in FIG. 8.

The subassembly of the plates 16 and 17 and associated legs 13, 14, and 15 is secured to the bottom of the platform 12 by a depending bolt 12*a* extending from the platform 12 and extending through a central aperture 16*a* in the plate 16 and an enlarged central opening 17*a* in plate 17 which accommodates a threaded knob 12*b*. The bolt 12*a* also provides a shaft for rotation of the platform 12 about a vertical axis.

The chair 1 is connected to the bench 11 by superimposing the upwardly inclined chair leg 7 on the downwardly inclined leg 15 of the bench and fixedly connecting them together by suitable bolts 18 and wing nuts 19.

Figure 2:
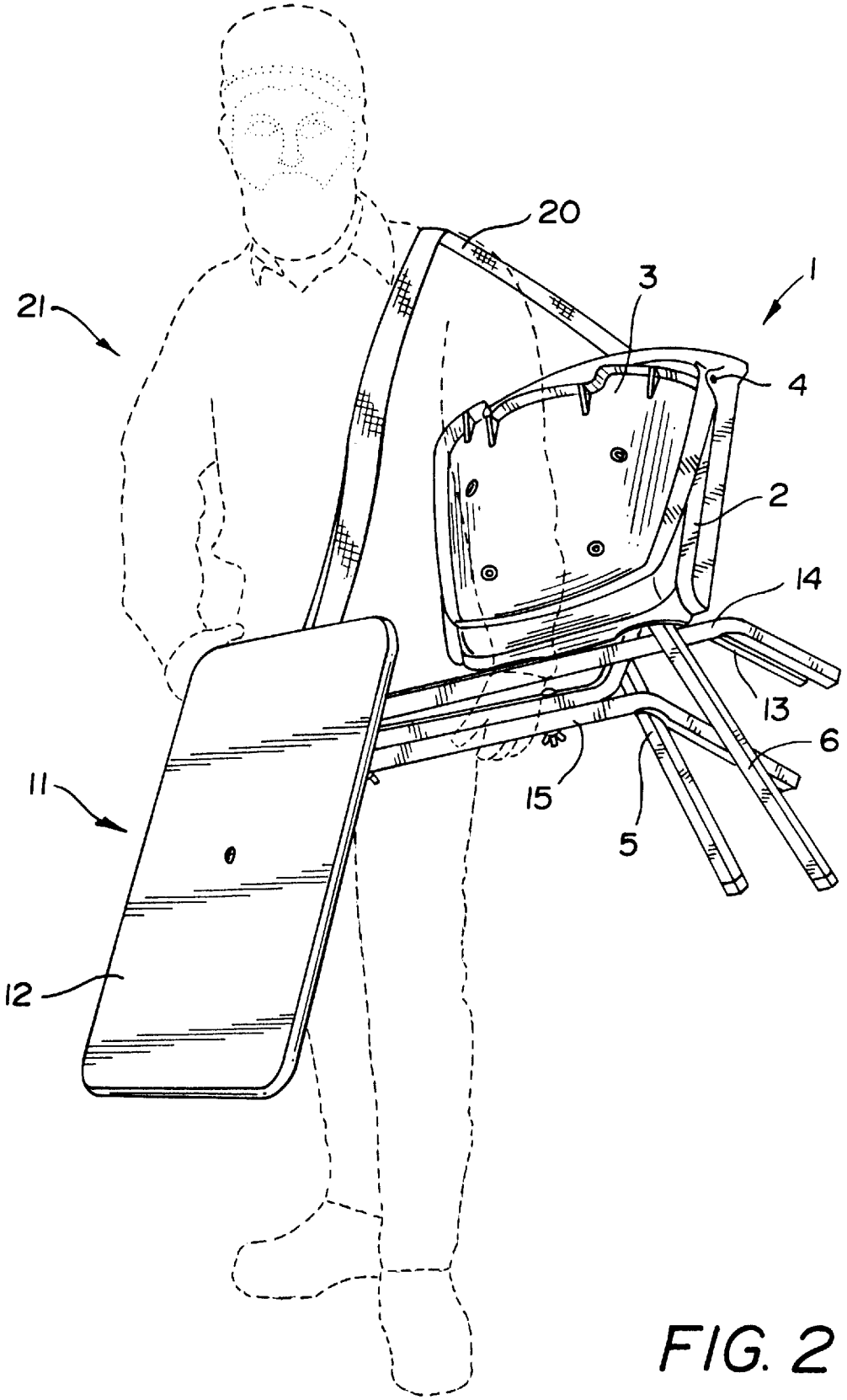
FIG. 2 is a perspective view of the seat and bench shown in FIG. 1, folded to a stored position for carrying by a shooter.
Figure 8:
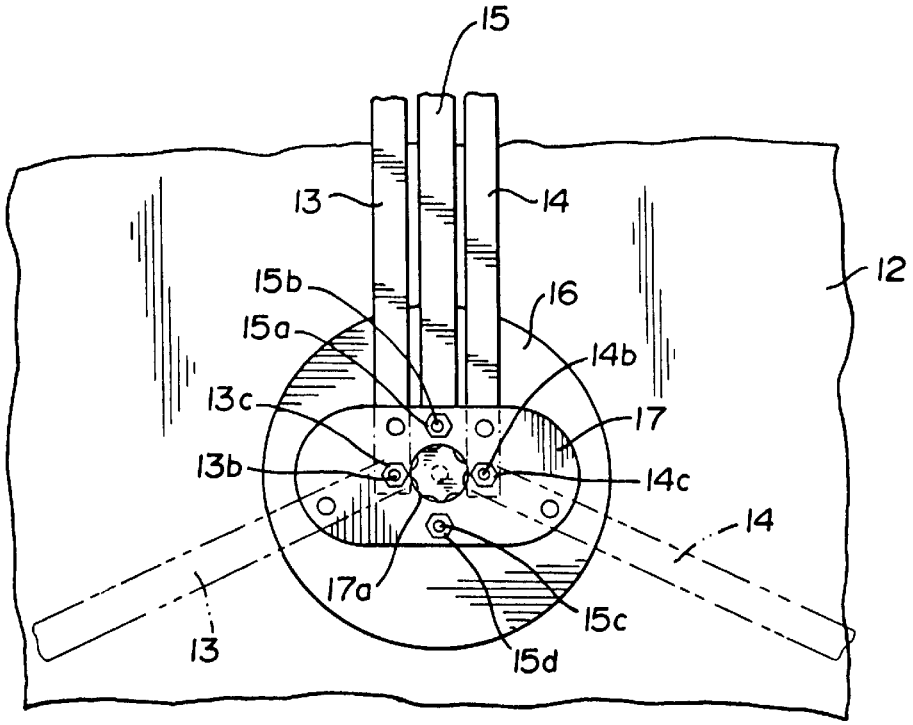
FIG. 8 is a fragmentary bottom plan view of the bench, illustrating the pivotal connections of the legs thereto.

To transport the seat I and attached bench 11, as shown in FIG. 1, the bench legs 13 and 14 are first pivoted to the position shown in solid lines in FIG. 8, and the seat legs 5 and 6 are then similarly pivoted toward the front of the seat portion 2 as shown in FIG. 2 to thereby straddle the folded bench legs 13 and 14. The back rest 3 is pivoted downwardly toward the seat portion 2, and a shoulder strap 20 is connected between the seat 1 and bench 11 to facilitate the carrying of the bench and associated seat by a shooter 21.

Figure 3:
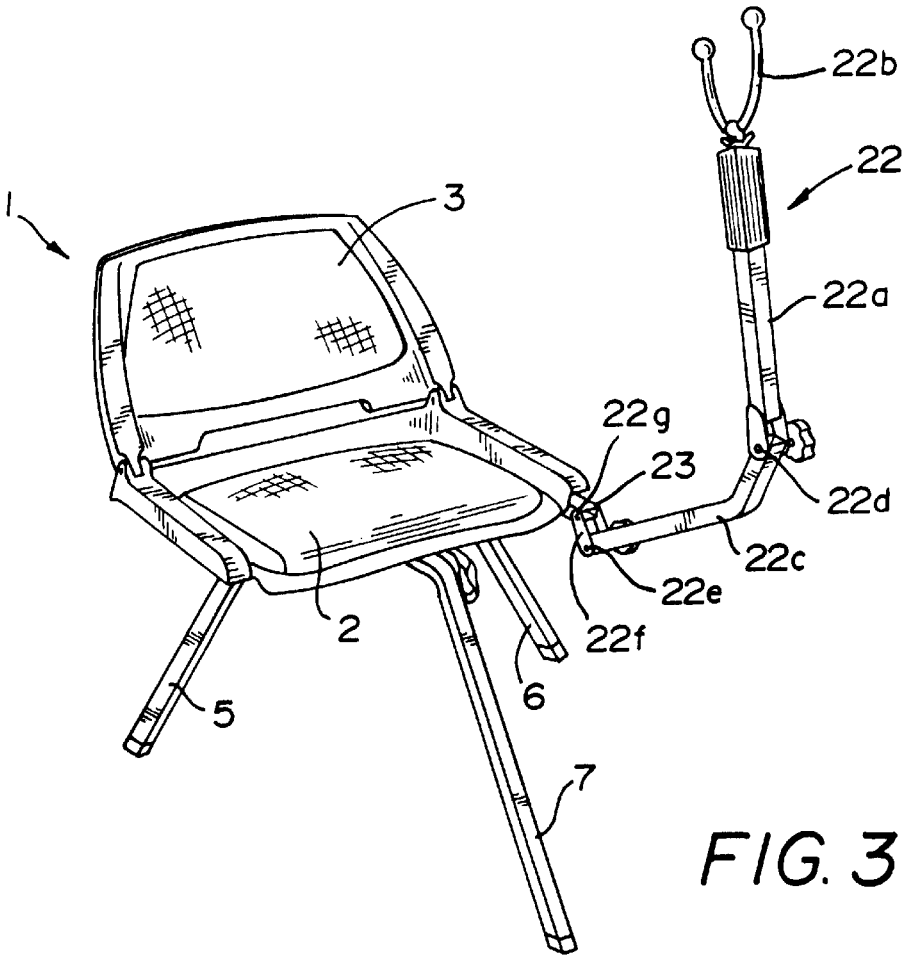
FIG. 3 is a perspective view of the seat shown in FIG. 1, disconnected from the bench and supported independently therefrom, and a firearm support connected to the seat.
Figure 4:
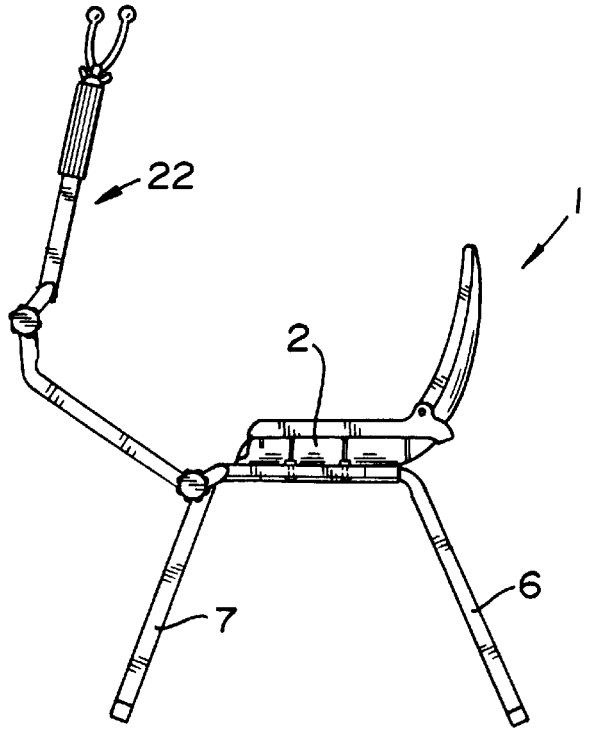
FIG. 4 is a side elevational view of the seat and firearm support shown in FIG. 3.
Figure 5:
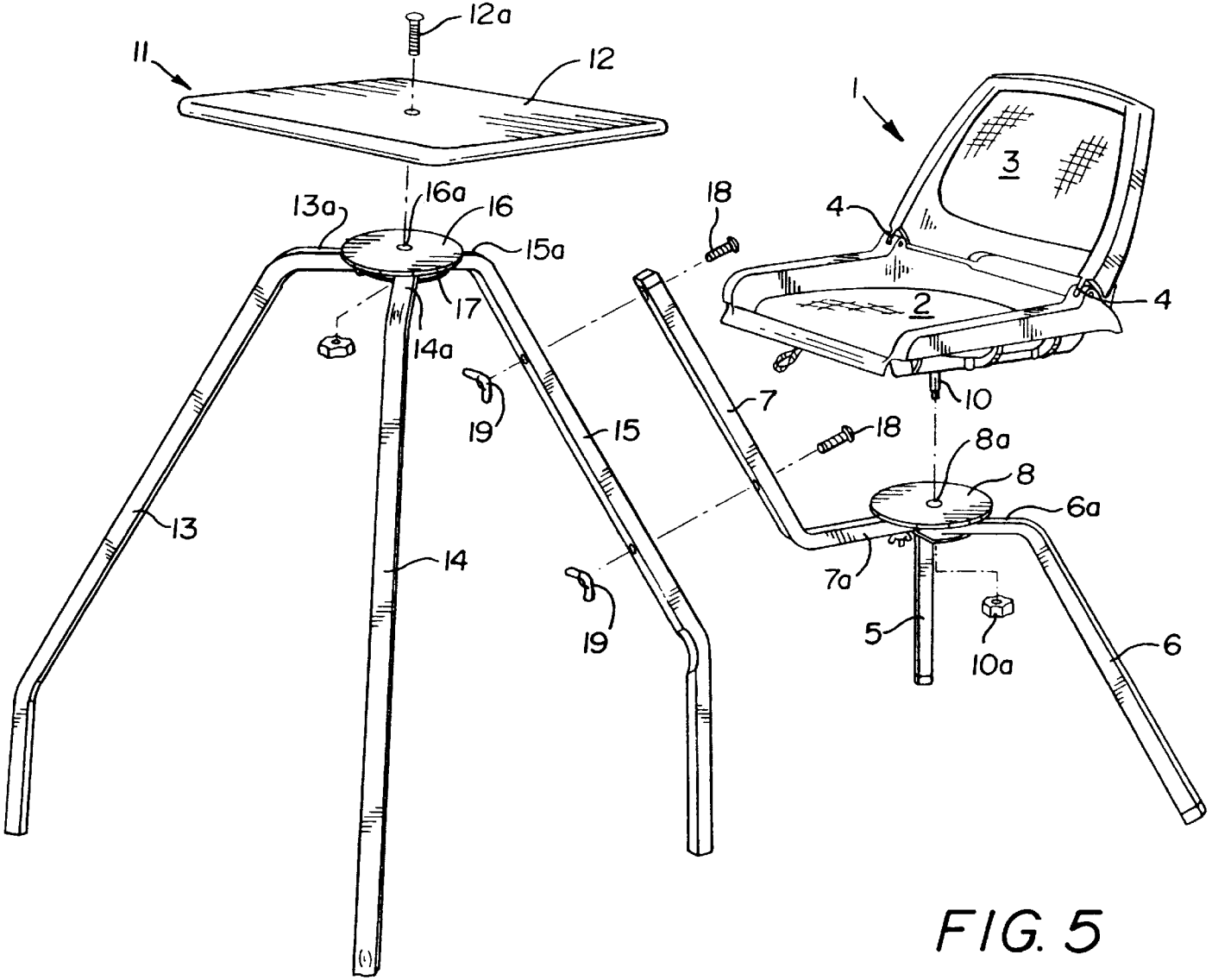
FIG. 5 is an exploded view of the bench and seat shown in FIG. 1.
Figure 6:
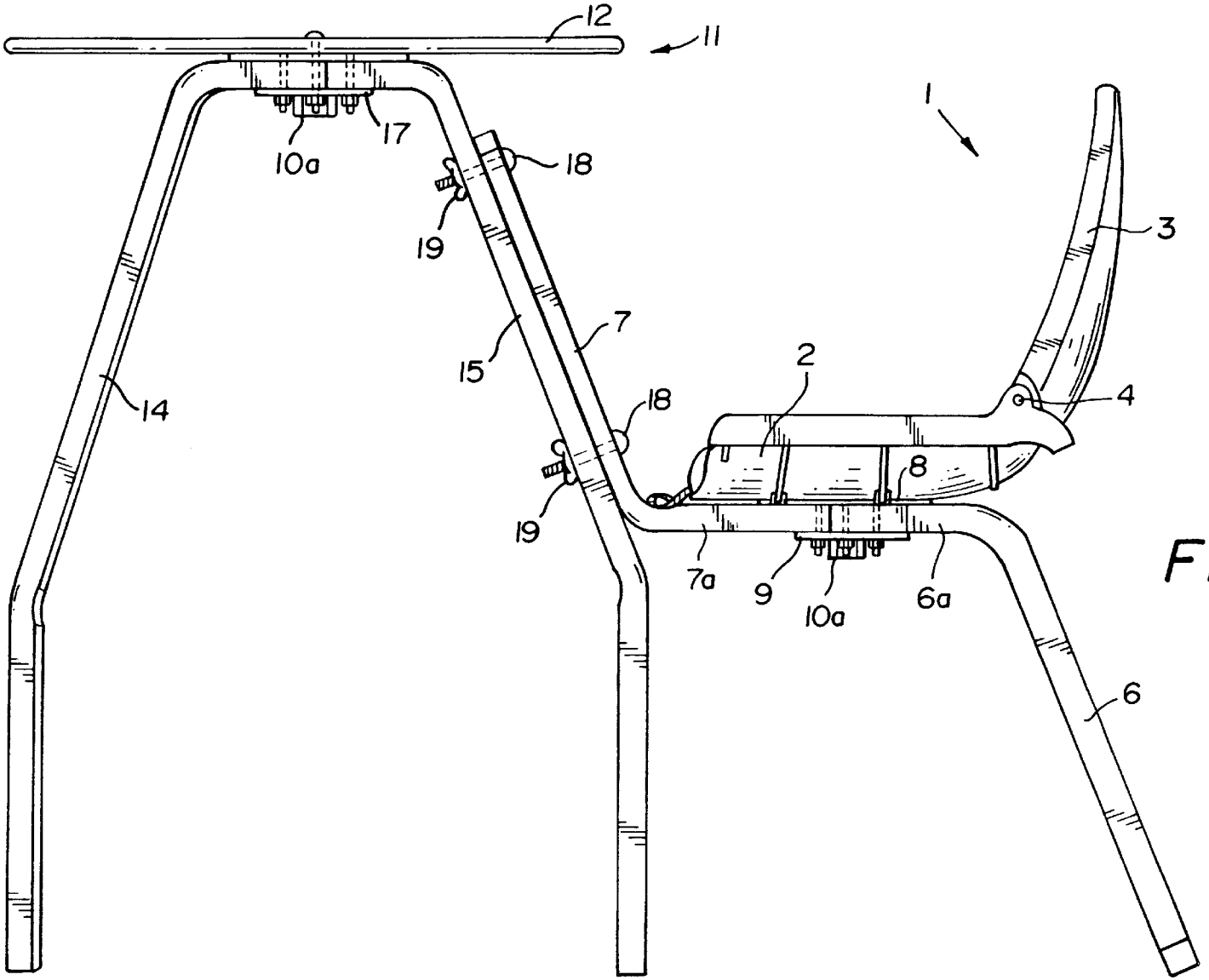
FIG. 6 is a side elevational view of the bench and seat shown in FIG. 1.

As will be seen in FIGS. 3 and 4, the seat 1 can be detached from the bench 11 for support on the ground independently from the bench 11. To accomplish this, the bolts 18 and wing nuts 19 are removed to disconnect the seat leg 7 from the bench leg 15, and the subassembly of the plates 8 and 9 and associated legs 5, 6, and 7 and connecting nut and bolt assemblies 5*b,* 5*c,* 6*b,* 6*c,* 7*b,* 7*c,* and 7*d,* and threaded knob 10*a* are removed to disassemble the subassembly. The inclined leg 7 is reoriented from the upwardly inclined position as shown in FIG. 6 to the downwardly inclined position as shown in FIGS. 3 and 4. The seat subassembly is then reassembled and connected to the bottom of the seat, as noted hereinabove. The seat can be employed merely as a chair or as a support base for a firearm support 22 comprising an arm 22*a* having a bifurcated member 22*b* at one end thereof providing a rest for a firearm. The opposite end of the arm 22*a* is pivotally connected to one end of another arm 22*c* about a horizontal axis as at 22*d.* The opposite end of the arm 22*c* is similarly pivoted as at 22*e* to one end of a link 22*f* pivotally connected as at 22*q* to a bracket 23 fixedly mounted to the front edge portion of the seat 2 at one side thereof. By this construction and arrangement, an articulated firearm support 22 is provided which can be held at various desired positions by threaded knobs 22*h* for tightening the pivotal connections 22*d* and 22*e.*

From the above description, it will be appreciated by those skilled in the art that the shooter's seat 1 of the present invention is an improvement over heretofore employed shooter's seats in that it can be readily attachable to a bench 11 and detachable therefrom for independent use as a support base for a firearm support 22. It is simple in construction, light in weight, and easily foldable for carrying by a shooter.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

We claim:

1. A portable shooter's seat selectively attached to a bench having a plurality of ground-engaging bench legs for supporting the bench above the ground, said seat being detachable from said bench for independent use as a support base for a firearm support, said seat comprising a seat portion, a plurality of ground-engageable seat support legs connected to said seat portion for supporting said seat above the ground, means for detachably connecting one of the plurality of seat legs to one of a plurality of bench legs, whereby when said one of the plurality of seat legs is connected to said one of the plurality of bench legs, the seat is connected to the bench, and the said one of the of seat legs is in a nonground-engaging position, while the remaining plurality of seat legs engage the ground, and when said one of the plurality of seat legs is disconnected form said one of the plurality of bench legs, the said one of the plurality of seat legs is moved to a ground-engaging position so that all of said plurality of seat legs engage the ground for supporting the seat independently from the bench.

2. A portable shooter's seat according to claim 1, wherein some of the plurality of bench legs have pivotal connections to the bench, and some of the plurality of seat legs have pivotal connections to the seat portion, whereby the bench legs and seat legs are foldable to a stored position to facilitate the carrying of the bench and associated seat.

3. A portable shooter's seat according to claim 2, wherein a shoulder strap is connected between the bench and seat to facilitate the carrying of the bench and seat.

4. A portable shooter's seat according to claim 2, wherein the pivotal connections include detent means for holding the pivotal bench and seat legs in the operative and stored positions.

5. A portable shooter's seat according to claim 4, wherein the pivotal connections include a plate, nut, and bolt assemblies connected between said plate and bench and seat legs to provide said pivotal connections, apertures in said plate, and buttons on said bench and seat legs insertable in said apertures to provide said detent means.

6. In combination, a portable shooter's seat and a bench, said seat comprising a seat portion and a back portion, a plurality of ground-engaging seat support legs connected to said seat portion for supporting the seat above the ground, said bench comprising a platform, a plurality of ground engaging support legs connected to said platform for supporting the platform above the ground, means for detachably connecting one of said plurality of seat support legs to one of said plurality of platform support legs, whereby when said one of said plurality of seat support legs is connected to said one of the plurality of platform support legs the seat is connected to the bench and the said one of the plurality of seat legs is in a nonground-engaging position, while the remaining plurality of seat legs engage the ground, and when said one of the plurality of seat legs is disconnected from said one of the plurality of platform legs, the said one of the plurality of seat legs is moved to a ground engaging position so that all of said plurality of seat support legs engage the ground for supporting the seat independently of the bench.

7. The combination according to claim 6 wherein said one of said plurality of platform legs is downwardly inclined and said one of said plurality of seat legs is upwardly inclined, said seat leg being superimposed on said platform leg.

8. The combination according to claim 7, wherein said seat leg is detachably connected to the bottom of the seat portion, whereby when the seat is detached from the platform, the seat leg can be detached from the seat and reoriented from the upwardly inclined position to a downwardly inclined position and reattached to the seat to thereby enable the seat leg to engage the ground.

9. The combination according to claim 6, wherein a firearm support is mounted on the seat.

10. The combination according to claim 9, wherein the firearm support comprises a first arm, a bifurcated member connected to one end of said first arm, a second arm, means for pivotally connecting the other end of said first arm to one end of said second arm, a link, means for pivotally connecting the other end of said second arm to one end of said link, a bracket connected to the seat portion of said seat, and means for pivotally connecting the other end of said link to said bracket.

* * * * *